United States Patent [19]

Surti

[11] Patent Number: 4,685,817

[45] **Date of Patent: * Aug. 11, 1987**

[54] RIBBON CARTRIDGE

[76] Inventor: Tyrone N. Surti, 424 Harding Industrial Dr., Nashville, Tenn. 37211

[ * ] Notice: The portion of the term of this patent subsequent to Dec. 16, 2003 has been disclaimed.

[21] Appl. No.: 855,072

[22] Filed: Apr. 22, 1986

Related U.S. Application Data

[63] Continuation-in-part of Ser. No. 725,931, Apr. 22, 1985, Pat. No. 4,629,346.

[51] Int. Cl.[4] ..... B41J 32/00

[52] U.S. Cl. ..... 400/208

[58] Field of Search ..... 400/207, 208, 208.1, 400/229, 235, 236; 242/192

[56] References Cited

U.S. PATENT DOCUMENTS

| | | | |
|---|---|---|---|
| 3,942,743 | 3/1976 | Jinsenji | 242/192 |
| 4,212,551 | 7/1980 | Marsico | 400/208 |
| 4,279,390 | 7/1981 | Wu et al. | 242/192 |
| 4,496,255 | 1/1985 | Meintrup et al. | 400/208 |

FOREIGN PATENT DOCUMENTS

| | | | |
|---|---|---|---|
| 162682 | 12/1981 | Japan | 400/236 |

*Primary Examiner*—Charles A. Pearson
*Attorney, Agent, or Firm*—C. A. Phillips

[57] ABSTRACT

A printer ribbon cartridge of the type employing two ribbon spools. In this one, the ribbon is driven by a belt engaging the spools and, in turn, the belt is engaged by both of two alternately driven drive rollers. The ribbon departure or arrival of a ribbon from or to a spool occurs on a side of a spool opposite to that of engagement of the belt with a spool.

4 Claims, 4 Drawing Figures

RIBBON CARTRIDGE

CROSS-REFERENCE OF RELATED APPLICATION

This invention is a continuation-in-part of application Ser. No. 06/725,931, filed Apr. 22, 1985, now U.S. Pat. No. 4629346, entitled "Printer Ribbon Cassette."

TECHNICAL FIELD

This invention relates generally to printing ribbon holders and particularly to spool-type ribbon cartridges of the type having separate, and spaced, drive inputs on opposite sides.

BACKGROUND OF THE INVENTION

Printers for printing out the outputs of computers are understandably varied in configuration. One very popular group, exemplified by NEC Models 2000/3500/8000, is of the daisy wheel type, printing a whole character with each stroke of printer operation. These printers employ a ribbon cartridge wherein a ribbon wound on and between two spools is impacted by a character print element of the printer. Cartridge configurations for these printers are illustrated by Meintrup et al U.S. Pat. No. 4,496,255, Shapiro U.S. Pat. No. 4,533,266 and Kano U.S. Pat. No. 4,544,291. A principal characteristic of such cartridges is that they employ two laterally spaced capstan drives, alternately driven through opposite sides of the cartridge by a rotary drive member of a host printer. One of the capstan drives drives a ribbon in one direction, wherein a top region of the ribbon is utilized in printing, and the other capstan drive drives the ribbon in the opposite direction and a bottom region of the ribbon is utilized. Each of the capstan drives consists of a drive roller and a pinch roller, and each capstan drive is associated with one of two spools of the cartridge. A belt is coupled between the driven roller and its associated spool, driving this spool, as a take-up spool, in a direction to receive the ribbon. This belt is positioned on the outside of the cartridge, connecting between pulleys on shafts of the drive roller and spool. In order to switch directions of drive, the cartridge is turned over and the belt is removed from pulleys on one side of the cartridge and placed around pulleys on the opposite side.

The belt and pulley arrangement discussed is an obvious disadvantage, both from the point of view of inconvenience and the variable tension effected upon the take-up spool as the amount of ribbon on it changes. Perhaps in recognition of the most blatant of these, the inconvenience, Meintrup suggests that an internal belt might be employed and cites a data tape cartridge manufactured by the 3M Company as providing such. This cartridge or cassette is illustrated in Von Behren U.S. Pat. No. 3,692,255, and a ribbon cartridge counterpart of it is illustrated in Sasaki U.S. Pat. No. 4,528,572. Upon examination of these references, it appears that both employ a single, centrally positioned drive member and thus are employable only with drive units, tape drives or printer drives, adapted to interface with a central position on a cartridge and not one where separate, spaced capstan drives are employed as required by the printers referred to above. Clearly, neither of these patents provide a teaching as to how one would employ an internal belt in a ribbon cartridge where the drive positions are spaced apart as in the class of cartridge we are concerned with here. In contrast, the inapplicability is manifest and is obvious from the fact that if a belt were stretched between the capstan drives of Meintrup, with an idler symmetrically positioned, e.g., where the drive roller is positioned in the case of Sasaki, the ribbon would be driven by the belt in one direction and the ribbon spool in an opposite direction, an inoperative condition.

In addition to the belt problem, another problem is that of generally providing needed tension on the ribbon of a dual capstan system. Ribbon tension is particularly necessary in the region where the print elements of the printer impact the ribbon to make an imprint on paper. It is important that the ribbon be held taut and constantly so. If there is insufficient tension, the ribbon will tend to drag on the paper and smudge it. If the tension becomes too great, there is a danger of breakage of a ribbon as a printing element impacts on it. Currently available cartridges constructed in accordance with the prior art simply reply upon mechanicam drag brought about by the frictional state of the bearing surfaces of a pinch roller, a drive roller, and a spool to provide proper tension. Unfortunately, these frictional factors vary, this variance being particularly commercially affected by constantly varying spool sizes as ribbon is fed to and drawn off of the spools. In any event, there is a substantial lack of consistency of ribbon tension.

A still further matter of concern with respect to the merit of ribbon cartridges is that of rate of use of ribbon. Ideally, the ink in the vicinity of an impact by a printing element will be completely utilized but not to the extent that a portion of a character being printed will receive insufficient ink. Pertinently, the rate of ribbon usage is a function of the speed of the rotating drive of the printer and the translation of this speed to a final ribbon drive speed, the latter being a function of the drive mechanism of the cartridge. Since the drive speed is thus fixed by a printer manufacturer, it is up to the ribbon cartridge manufacturer to provide a cartridge which will provide an optimum rate of ribbon advancement for the drive speed at hand. Unfortunately, it appears that because of certain structural limitations imposed by the mechanisms employed in prior art ribbon cartridges, they effect a higher rate of ribbon travel than is actually necessary to provide good print quality. Specifically, it appears that this is the result of employing a direct capstan drive of ribbon, which in turn has necessitated the employment of toothed surfaces to obtain sufficient grip on a ribbon to reliably advance it. This in turn has resulted in an excessive effective diameter of the drive roller, resulting in an excessive effective rate of ribbon advancement.

SUMMARY OF THE INVENTION

In accordance with this invention, alternately, one of two drive rollers, driven by a printer, drives an internally located belt, and this belt engages the ribbon at two locations where it is wound on the spools, it further engages an idler roller, and it engages the other (then undriven) drive roller. The ribbon is not engaged by a drive roller either directly or through the thickness of the belt. The idler roller is positioned to hold the belt against the ribbon where it is wound on ribbon spools. A drive roller driven by the printer drives the belt in a direction wherein the belt initially moves longitudinally, as by stretching, in the region between the driven roller and across an adjacent ribbon spool to the idler roller. Thus, tension is applied to that ribbon spool, and this is followed by stretching of the ribbon, after which the ribbon spool commences rotation, winding ribbon on it. Next, longitudinal movement of the belt reaches and applies an unwinding enablement to the other spool. This sequence effects and maintains an optimum ribbon tension.

As further feature of this invention, the drive roller would be made with a generally even cylindrical contour. By this approach, the effective diameter of the roller is reduced, enabling a lower ribbon drive speed, which results in a significant economy of ribbon usage.

DETAILED DESCRIPTION OF THE DRAWINGS

Figure 4:
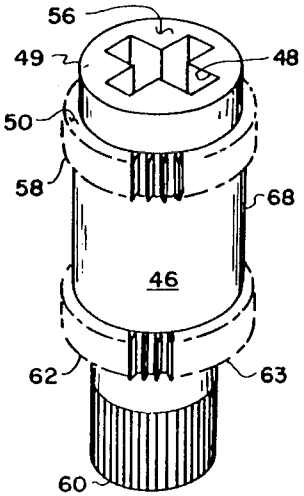
FIG. 4 is an enlarged pictorial view of a capstan or drive gear employable in the embodiment of the invention illustrated in FIGS. 1–3.
Figure 3:
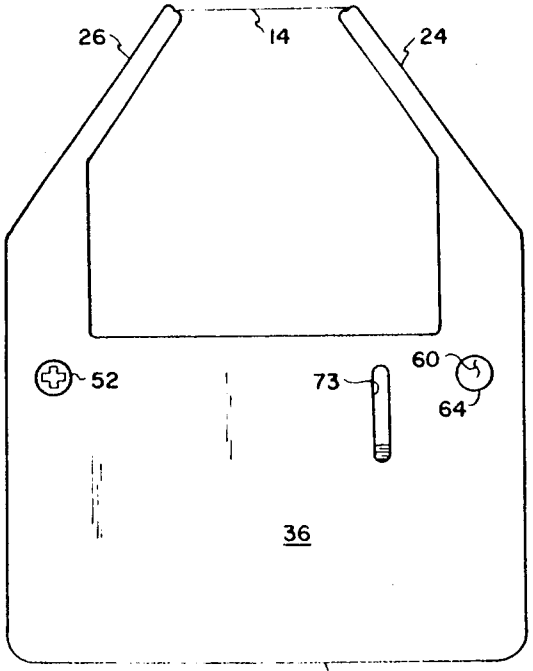
FIG. 3 is a bottom plan view of the cassette shown in FIG. 1.
Figure 2:
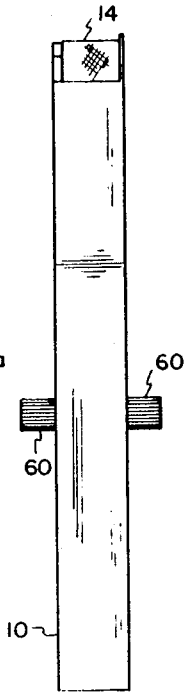
FIG. 2 is a side view of the cassette of FIG. 1.

Referring to the drawings, a ribbon case 10 houses in cavity 12 transport and storage means for a printing ribbon 14. Ribbon 14 is stored on and winds between spools 16 and 18 and is guided in a path which ultimately places it between ribbon guides 20 and 22. Guide 20 is supported on the front side of case 10 by arm 24, and guide 22 is supported on this side of the case by oppositely, supported arm 26. A print head from a host printer (not shown) effects printing on, for example, paper by a print character being impacted through a generally central region of ribbon 14 between guides 20 and 22.

Ribbon spools 16 and 18 are conventionally supported by stub axles 28 and 38 extending from broad side 11 of case 10.

Ridge members 90, 92, 94, and 96 form spaced supports to provide stability for the assembled cartridge. When in place, cover 32 is attached via pins (not shown) which extend into opening 71 spaced about the cartridge.

Each of drive rollers **46*a* and 46*b* is illustrated by an identical drive roller 46 shown in FIG. 4, and the latter designation may refer to either of the two former ones. It includes a cross-shaped opening 48 in one end 49 which fits over a flat key drive (not shown) of a printer, the flat key mating with one of the crossed regions of opening 48. A bearing region 50 of drive roller 46*a* fits within mating opening 52 of side cover 36, and a like region 50 of drive roller 46*b* fits in a mating opening 54 of side cover 32. End 56 is generally flush with the outside of case 10. An enlarged (in diameter) collar region 58 effects axial restraint of drive roller 46 (46*a* or 46*b*) in one side 11 of case 10. Opposite end or end region 60 of each drive roller extends through and outside of an opposite side of case 10. A collar 62 of a drive roller provides a shoulder bearing for axially positioning of bearing region 63 of drive rollers 46*a* and 46*b* within opening 54 of side cover 32 and opening 64 of side 11 of case 10**.

Belt 70 (see dotted lines) interconnects drive rollers **46*a* and 46*b* and effects a positive drive between the drive roller being driven by the printer and ribbon 14. Belt 70 is held in tension by an idler roller 72, the latter being positioned to provide a belt path which holds belt 70 against ribbon 14 where it is wound on spools 16 and 18. Collars 58 and 62 on either side of flat pulley region 68 of each drive roller assure that belt 70 will be generally held into alignment with ribbon 14 without special close tolerances between the drive rollers and the openings in case 10** within which they ride. While the collar regions are toothed, as shown, they do no affect the drive diameter of the drive rollers and may be made simply solid.

Idler roller 72 is generally positioned toward a rear side of case 16 along a line bisecting case 10 between the axis of spools 16 and 18, this line being generally normal to the linear portion of travel of belt 70. While idler roller 72 is fixedly mounted as shown, it may be spring loaded to permit travel to a selected ribbon region, for example, along the locational line just referred to. In this case, belt 70 may be essentially non-stretchable and tension described above would be provided by the spring biasing of idler roller 72. Openings 73 provide a view of the state of ribbon on one of the spools, there being an opening 73 in each of the two sides of case 10 such that one spool is observable from one side and the other from the other side.

Drive of belt 70 is effected by the particular drive roller, **46*a* or 46*b* in engagement with the host printer. Assuming that it is 46*a*, drive would be in the direction of arrow 74, the belt then passing over drive roller 46*b*, which then functions as an idler, then over the generally top side of the ribbon on spool 18, then moving on and around idler 72, then back over the ribbon on spool 16 to drive roller 46*a*. In terms of FIG. 1, cartridge 10 would lie generally horizontal and one would be looking down on the cartridge, and the underside (not shown) of drive roller 46*a*** would be engaged with the printer.

With drive occurring as described in the foregoing paragraph, ribbon 14 would be passing off of the generally rear side of spool 18, then outwardly toward one end side and around guide 76, thence outward of drive roller **46*b* to guide 78, guides 76 and 78 assuring that ribbon 14 does not engage or rub on belt 70. Ribbon 14 then passes, as shown by arrow 88, on and by guide 80, then over and between guides 20 and 22. Then it passes over guides 82, 84, and 86 on the opposite side of cartridge 10, arranged in the same manner as described for guides 76 and 78 and thence onto spool 16**.

With cartridge 10 turned over, drive roller **46*b* would be in engagement with the printer. Belt 70 would then move in the reverse direction as would ribbon 14. While in view of the positive drive in both directions, hand adjustment of tension of belt 70 or ribbon 14 is not generally necessary, the end region 60 of a drive roller is available as a means of rotating the drive system and is useful in effecting alignment between openings 48** of a drive roller and a host printer.

Referring to cartridge 10 in an operating position, where it is horizontal, a significant portion of half (top or bottom) of ribbon 14 is impacted by the print characters of a printer during travel of ribbon 14 between spools 16 and 18. An arm (not shown) from a host computer extends through the openings 73 of the case 10, and when the ribbon has been fully wound from one spool, e.g., spool 16, and wound on the other, e.g., spool 18, this arm operates a switch in the printer to turn the printer off. This signals the operator to turn the cartridge over such that drive roller **46*b* will engage the drive for the host printer rather than 46***a*. The result will be that belt 70 and ribbon 14 will reverse their direction, and the opposite half (top or bottom) of ribbon 14 will be utilized by the printer. Significantly, however, cartridge 10, having an internal belt drive, does not require belt transfer from one side to the other when there is a reversal of operating sides of the cartridge as described.

Figure 1:
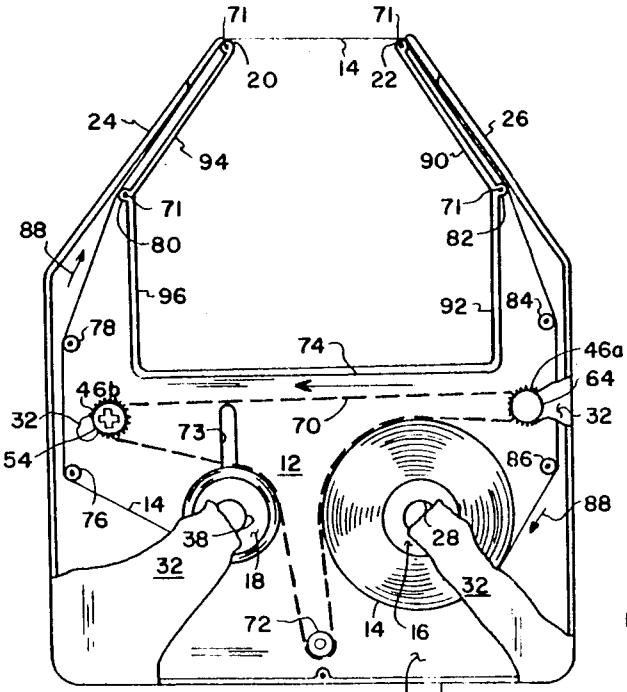
FIG. 1 is a top plan view, partially broken away, of an embodiment of ribbon cassette constructed in accordance with the present invention.

By means of the construction disclosed, an optimum belt tension is maintained in belt 70 such that ribbon 14 is always under a degree of tension, but implicitly the tension is below the level at which there is danger of ribbon 14 breaking. This tension would typically be in the range of from one to four ounces. With such a tension, drive would proceed as follows. With drive roller 46*a* driven, belt 70 is initially put in tension in the region where it extends over the ribbon on spool 16, thus applying a clockwise torque to spool 16 as illustrated in FIG. 1. This is then followed by spool 16 commencing to rotate clockwise and in turn there being applied a tension to ribbon 14 in the direction of arrow 88. Therafter, and after continued pull on ribbon 14, this tension is partially relieved as the tension is belt 70 extends spool 16 and idler 72 and then further extends to spool 18 where it enables unwinding of the ribbon on spool 18. By this process, it is assured that there will persist, constantly, sufficient but not excessive tension in ribbon 14 in its critical area between guides 20 and 22.

Of further significance is the fact that belt carrying region 68 of the drive rollers is made cylindrical and is not toothed as in the case of the drive surface of the prior art cartridges referred to above. This change is enabled by virtue of the fact that the drive rollers drive a belt which may be under greater tension than the ribbon. This enables a thinner wall thickness for the drive capstan or drive roller and thus a smaller effective diameter. This in turn enables a reduction in rate of drive imparted to the belt and thus to the ribbon. The result is that there is a reduction of approximately 25% in the rate of ribbon travel. Importantly, it has been found that, despite this reduction, the quality of print is not noticably degraded, and thus in effect a user will achieves an approximately 25% reduction in ribbon usage.

By the foregoing, the applicant has provided a significantly improved reversible drive ribbon cartridge wherein an outer belt is eliminated. Distinctively, the drive belt is placed internally and requires no disassembly and reassembly. Operably, it applies a torque to one ribbon spool in a direction which effects a winding on that spool of the ribbon which in turn applies a tension to the ribbon across its working station. Thereafter, by virtue of a transmission of tension along the belt, the belt thereafter applies a relaxation of tension to the other ribbon spool. By virtue of this distinct sequence of application of force and relaxation of tension to the ribbon, an ideal tension is maintained at the print station between gides 20 and 22. Finally, by the elimination of the toothed portion of the drive roller where it effects drive, the effective diameter of the drive roller is reduced and thereby a significant increase in usage of ribbon is obtained with the same printer driver.

What is claimed is:

1. A ribbon cartridge for a printer having a drive member, and comprising:

a case having an internal storage cavity generally defined by sides of said case and including broad opposite face sides, front and rear opposite sides, and first and second opposite end sides;

a ribbon;

first and second spaced arms extending outward from said front side of said case and first ribbon guide supported by said first arm and a second ribbon guide spaced from said first ribbon guide and supported by said second arm, and said first and second ribbon guides supporting said ribbon in a region impacted on by elements of a printer;

first and second spaced drive rollers within said case, said first drive roller having a drive member adapted to be driven from said printer through one said broad side of said case, and a said second drive roller being adapted to be driven from said printer through an opposite said broad side of said case, and said drive rollers positioned generally adjacent said end sides of said case, whereby one of said drive rollers would be driven at a time;

first and second spools spaced within said cavity, and said first spool being positioned generally proximate said first drive roller, and said second spool being positioned generally proximate said second drive roller;

at least one third ribbon guide positioned to guide said ribbon toward a said end side and along a path spaced from said first drive roller, and at least one fourth ribbon guide positioned to guide said ribbon toward an end side and along a path spaced from said second drive roller;

an idler roller positioned generally between said spools and adjacent said rear side;

said ribbon having opposite end regions wound on said spools and otherwise extending outward from a side region of each said spool generally facing said rear side, then extending over said third and fourth guides to and between said first and second guides, thus defining a path pattern wherein said drive rollers are within the confines of said pattern and out of contact with said ribbon; and a belt extending around said drive rollers and said idler roller and generally over regions of ribbon on said spools, said last-named regions generally facing said front side of said case;

whereby, upon drive being applied to said first drive roller, it initially applies directive tension to said belt and a winding tension to ribbon wound on said first spool, then with movement of said first spool, the ribbon tension migrates to and beyond said idler roller to engagement of said ribbon with said second spool, and enabling unwinding of said ribbon from said second spool under a generally constant tension.

2. A ribbon cartridge for a printer as set forth in claim 1 wherein said belt comprises a stretchable belt.

3. A ribbon cartridge as set forth in claim 2 wherein said drive rollers each include an even cylindrical contour, and said belt is positioned around said even cylindrical contours of said drive rollers.

4. A ribbon cartridge as set forth in claim 3 wherein each said drive roller includes a raised collar on either side of said even cylindrical contour.

* * * * *